United States Patent [19]

Herriott

[11] 4,287,734

[45] Sep. 8, 1981

[54] COMBINATION LOCK MECHANISM

[76] Inventor: Leslie V. Herriott, 31, Forton Close, Compton Ridge, Wolverhampton, England

[21] Appl. No.: 39,753

[22] Filed: May 17, 1979

[30] Foreign Application Priority Data

May 18, 1977 [GB] United Kingdom ..... 20824/77

[51] Int. Cl.[3] ..... E05B 63/00

[52] U.S. Cl. ..... 70/333 A; 70/312

[58] Field of Search ..... 70/2, 3, 5, 67-76, 70/312, 333 A, 332

[56] References Cited

U.S. PATENT DOCUMENTS

| | | | |
|---|---|---|---|
| 1,002,338 | 9/1911 | Tamburini | 70/333 A |
| 1,652,897 | 12/1927 | Hill | 70/333 A |
| 1,942,454 | 1/1934 | Samburg | 70/333 A |
| 2,690,664 | 10/1954 | Miller | 70/333 |
| 3,405,544 | 10/1960 | Gehrie | 70/312 |
| 3,597,945 | 8/1971 | Feinberg | 70/68 |
| 3,835,680 | 9/1974 | Evans | 70/333 A |
| 3,851,507 | 12/1974 | Gehrie | 70/312 |
| 4,155,234 | 5/1979 | Bako | 70/312 |

FOREIGN PATENT DOCUMENTS 1329791 5/1963 France .

*Primary Examiner*—Robert L. Wolfe

*Attorney, Agent, or Firm*—Merriam, Marshall & Bicknell

[57] ABSTRACT

Indicating wheels of a combination lock are normally viewed through respective windows which are displaced from alignment with the wheels when the lock is released. The wheels are then obscured so that the combination to which the lock has been set for release cannot be observed. The windows contain optical lenses.

9 Claims, 4 Drawing Figures

COMBINATION LOCK MECHANISM

BACKGROUND TO THE INVENTION

This invention relates to a combination lock mechanism, by which we mean a lock mechanism comprising an operating member which, when the mechanism is in use, normally imposes a constraint on an associated device but can undergo releasing movement to discontinue the constraint and a plurality of settable members, each of which can be set by an operator in a selected one of a number of alternative positions, it being necessary for the operator to establish a predetermined combination or one of two or more predetermined combinations of respective positions of the settable members before releasing movement of the operating member can occur. In some locks incorporating a combination lock mechanism, the settable members are accessible and are moved directly by the operator. In other locks incorporating a combination lock mechanism, the settable members are not accessible directly and a separate driving member is provided through which the operator transmits drive to the settable members.

SUMMARY OF THE INVENTION

According to the invention, there is provided a combination lock mechanism comprising indicating means for indicating visually to a user the position to which one of the settable members has been set and means for obscuring the indicating means when releasing movement of the operating member is effected.

The means for obscuring the indicating means may comprise a window, preferably incorporating a magnifying lens through which the indicating means can be viewed whilst said one settable member is being set, and the window and settable member undergoing relative movement when releasing movement of the operating member is effected, the relative movement being such as to obscure the indicating means.

There is preferably associated with each settable member a respective driving element which is accessible to a user and when the obscuring means and settable members undergo relative movement, relative movement of the driving elements and settable members also occurring, the driving elements remaining stationary relative to the obscuring means.

There may be provided a respective window for each settable member, each window being close to the corresponding driving element. By the description "close" we mean that each window is not spaced from the corresponding driving element by a distance which is substantially larger than the distance through which relative movement of the obscuring means and settable members occurs.

BRIEF DESCRIPTION OF THE DRAWINGS

One example of a lock embodying the invention is illustrated in the accompanying drawings wherein.

DETAILED DESCRIPTION

Figure 1:
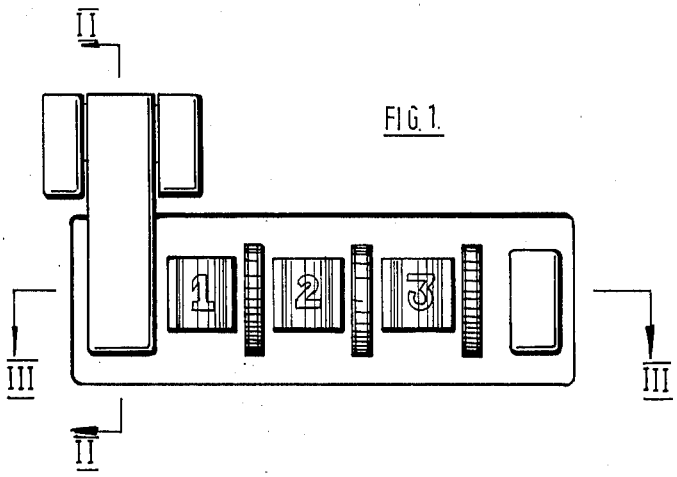
FIG. 1 shows a front elevation of a lock incorporating a combination lock mechanism in accordance with the invention.
Figure 4:
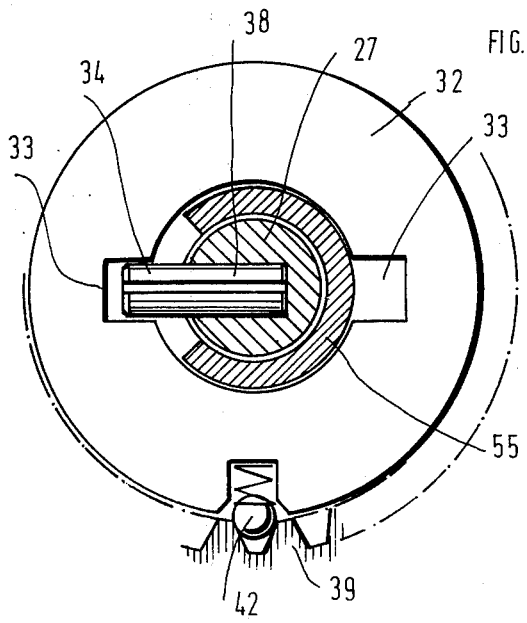
FIG. 4 shows on an enlarged scale a cross section on the line IV—IV of FIG. 3.

The lock shown in the accompanying drawing is intended for incorporation in a brief case, suit case or the like and includes a body 10 which is intended to be mounted on a front wall of a lower part of the case and a hasp assembly 11 which is intended to be mounted on a front wall of an upper part or lid of the case. The lid and lower part of the case are usually pivotally connected at the rear of the case and the lock is required to hold the respective front walls of the lower part and lid in abutting relation when the case is closed. Alternatively, the arrangement may be such that the front walls are held in overlapping relation.

The hasp assembly 11 includes a hasp 12 mounted on a carrier 13 for pivoting movement about an axis 14 towards and away from the body 10 when the case is closed.

The body 10 of the lock comprises a generally rectangular base member 15, a generally rectangular cover 16 and a pair of end members 17 and 18. The end members are formed with recesses which receive end portions of the cover 16 when the body is assembled. Each end member further comprises a pair of spacer elements which, in the assembled body, lie between the cover 16 and the base member 15 and space these apart by a predetermined distance. From the free end of each spacer element there projects a fastener shank 19 which passes through a corresponding aperture in the base member and is secured therein by a respective fastener 20. The shanks 19 are preferably integral with the end members 17 and 18.

When the lock is assembled with a case, the body 10 is secured to the front wall of a lower part of the case. In this wall there is formed an aperture of a size somewhat smaller than that of the base member 15 and certain parts of the lock mechanism which are disposed within the body 10 lie within this aperture in the case wall. The spacer elements of the end members 17 and 18 extend through the aperture in the case wall. The length of the spacer elements corresponds to the thickness of the front wall of the case so that portions of the front wall bordering the aperture therein are firmly gripped between the base member 15 on the one hand and the cover 16 and end members 17 and 18 on the other hand.

A retaining member 21 is pivotally mounted in the body 10 by means of a pivot pin 22, a mid portion of which extends through an aperture in the retaining member. Opposite end portions of the pivot pin are received in apertures formed in parallel wall portions 23 and 24 of the base member 15. The retaining member can move between an operative position shown in full lines in FIG. 2 and an inoperative position indicated by a chain line in FIG. 2. The retaining member is urged towards its inoperative position by a torsion spring 25 acting between the retaining member and the base member 15.

Figure 2:
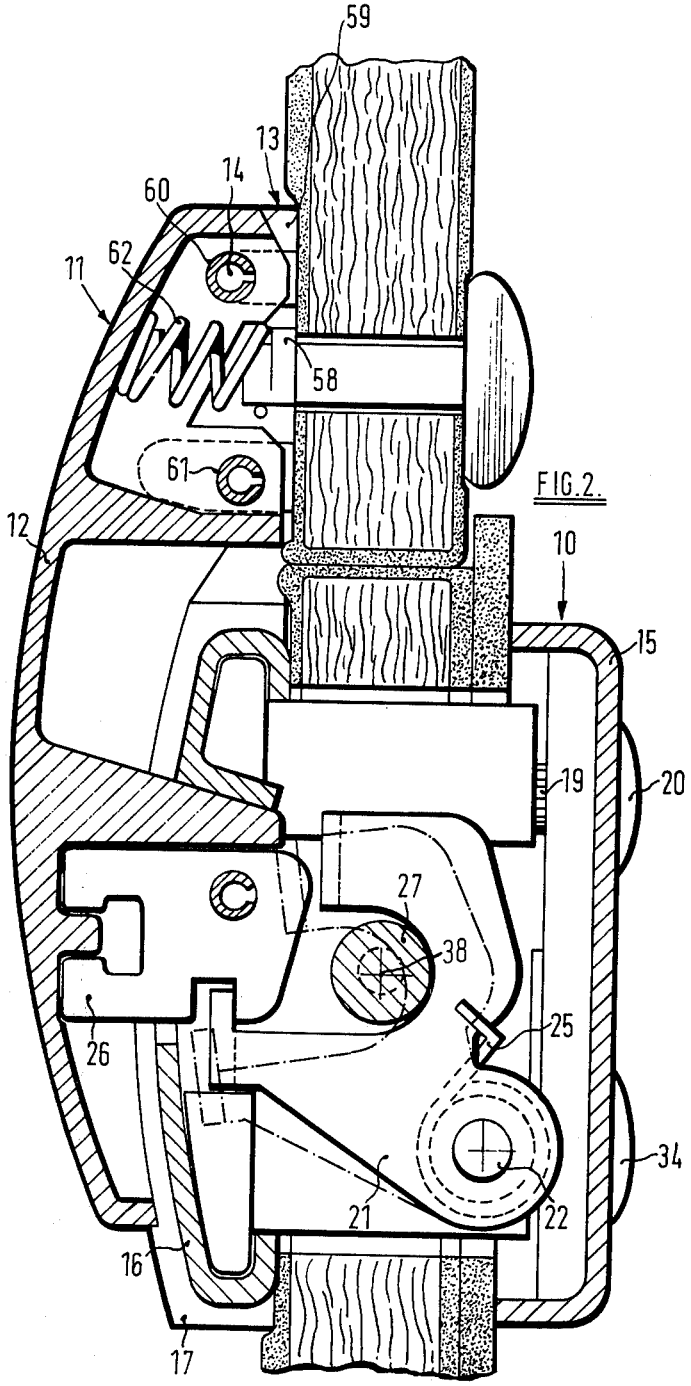
FIG. 2 shows a cross section on the line II—II of FIG. 1.

In the cover 16, there is formed a first aperture to receive a hook element 26 of the hasp 12. As shown in FIG. 2, the element 26 is preferably a structurally separate component which is secured to the main part of the hasp. When the hook element is inserted through the first aperture of the cover, it can be engaged by the retaining member 21 as shown in FIG. 2. Whilst the retaining member remains in its operative position, it retains the hasp in the position shown in FIG. 2.

Figure 3:
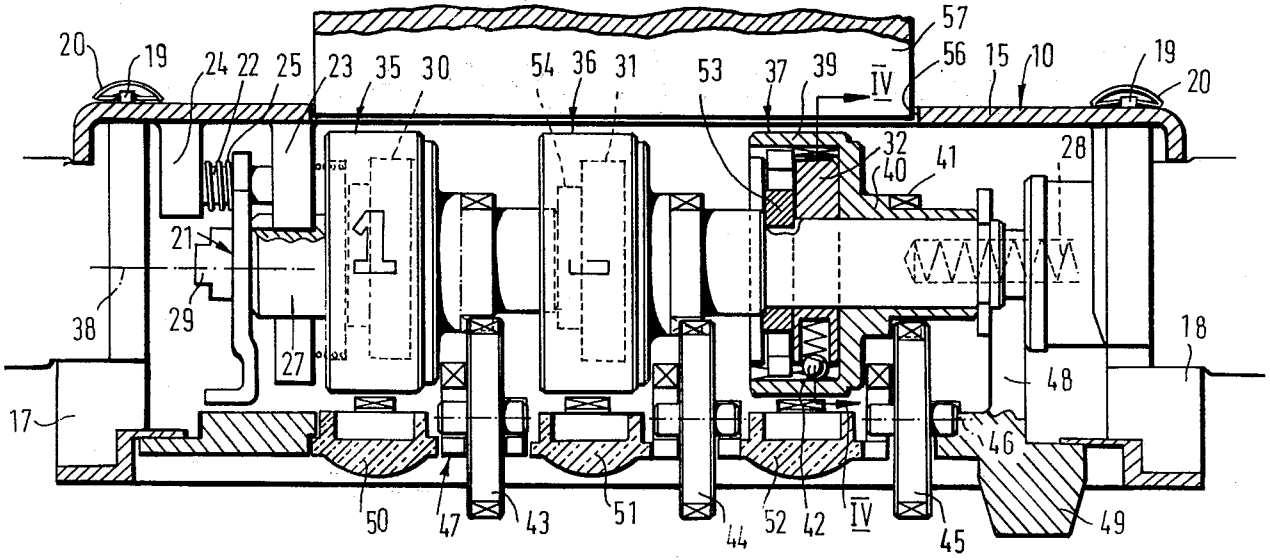
FIG. 3 shows a plan view partly in cross section on the line III—III of FIG. 1, a door of a body of the lock being shown in an open position.

The retaining member 21 is held in its operative position by an operating member in the form of a latch 27. The latch is of generally cylindrical form and extends along the interior of the body 10 from the retaining member 21 and is urged towards the retaining member by a spring 28 which acts between one end of the latch and an abutment on the base member 15. An end portion 29 of the latch which is remote from the spring 28 has a smaller diameter than does the remainder of the latch. The latch normally occupies a position shown in FIGS. 2 and 3 in which a larger diameter portion of the latch engages in a mouth defined by the retaining member 21 and so constrains the retaining member against pivoting on its pin 22. To release the hasp 12, the latch can be moved against the action of its spring 28 to bring the reduced diameter end portion 29 of the latch into the mouth of the retaining member and so permit movement of the retaining member to its inoperative position.

Whilst the retaining member 21 remains in its inoperative position, it prevents the latch returning to its normal position and holds the latch in a releasing position (not shown) in which the spring 28 is compressed.

For controlling movement of the latch 27 between its normal position and its releasing position, there are provided three settable members 30, 31 and 32. Each of the settable members is of generally annular form, having a central opening through which the latch 27 extends. In the radially inwardly presented surface of each settable member, there are formed two recesses 33 which occupy diametrically opposite positions. Three pins 34 are rigidly mounted in the latch 27 so as to project radially therefrom in the same direction. These pins are spaced apart longitudinally of the latch by distances corresponding to the spacings between the settable members 30, 31 and 32. Each of the recesses 33 is of such a size that it can accommodate the projecting portion of a corresponding one of the pins 34 when the latch is moved into its releasing position. In the normal position of the latch the pins 34 lie outside their respective settable members.

It will be understood that the latch 27 can be moved into its releasing position only when a recess 33 of each settable member is aligned with a corresponding one of the pins 34. If this alignment is not established, movement of the latch to its releasing position is prevented by engagement of the pins 34 with axially presented surfaces of the settable members.

In association with each of the settable members 30, 31 and 32, there is provided a respective indicating element 35, 36 and 37 for indicating to a user the angular position of each settable member relative to the pins 34. The latch is constrained against rotation about its longitudinal axis 38 by means of a key (not shown) on the base member 15 which engages in a slot (not shown) formed in the end portion of the latch adjacent to the spring 28.

Each indicating element is in the form of a stepped sleeve having a larger diameter portion 39 which embraces the corresponding settable member and a smaller diameter portion 40 formed externally with a row of gear teeth 41 which extends completely around the axis 38. The radially inwardly presented surface of each indicating element is of corrugated form, so that it presents a series of seats for a spring-loaded ball 42 which protrudes from a socket formed in the peripheral surface of the associated settable member. During normal use of the lock the ball 42 transmits torque between the indicating element and the associated settable member so that no relative movement of these two components occurs and they rotate together about the axis 38.

In the particular example illustrated, each of the indicating elements 35, 36 and 37 presents twenty seats for the associated balls 42 so that twenty alternative positions of each indicating element relative to the associated settable member can be established by turning the indicating element relative to the settable member in the manner hereinafter described. On the radially outwardly presented surface of the larger diameter portion 39 of each indicating element there are marked twenty indicia for indicating the position of the settable member to a user. The indicia comprise the digits 0 to 9 and each digit is duplicated at diametrically opposite positions on the surface of the indicating element. It is because of duplication of the indicia that each recess 33 is duplicated.

Means is provided for enabling an operator to drive each of the settable members 30, 31 and 32. The driving means comprises three driving elements 43, 44, 45 associated respectively with the settable members 30, 31 and 32. The driving elements are mounted for rotation independently of one another about a common axis 46 in a carrier 47. The carrier occupies a second aperture in the cover 16 and is arranged for limited sliding movement relative to the cover in a direction along the axis 38. The carrier is coupled to the latch 27 by a coupling element 48 on the carrier so that the carrier and latch are constrained to move together along the axis. To facilitate movement of the carrier and latch against the action of the spring 28, there is provided on the carrier a projection 49 which is accessible to a user.

Each of the driving elements 43, 44 and 45 is formed at its periphery with a series of teeth having the same pitch as the teeth 41 on the indicating elements. When the latch 27 is in its normal position, the teeth on the driving element 43 mesh with the teeth on the indicating element 35, the driving element 44 is in driving engagement with the indicating element 36 and the driving element 45 is in driving engagement with the indicating element 37. When the latch is moved to its releasing position, the driving elements are moved out of driving engagement with the indicating elements. A sector of each driving element protrudes from an exposed surface of the carrier 47 so as to be accessible to a user.

To enable a user to ascertain the position of each of the settable members 30, 31 and 32, the carrier 47 is formed with a plurality of windows, one for each indicating element 35, 36 and 37, so that the indicia on the indicating elements can be viewed when the latch is in its normal position. Means is provided for obscuring the indicia when the latch is moved to its releasing position. The obscuring means comprises three lenses 50, 51 and 52 which are comprised by the windows of the carrier. Each lens magnifies a part of the lock mechanism which lies directly between the centre of the lens and the axis 38 but renders obscure whatever underlies peripheral parts of the lens. The arrangement is such that, when the latch is in its normal position, each lens magnifies one indicium on the associated indicating element. When the latch occupies its releasing position, none of the indicia are legible through any of the lenses.

To avoid the risk of torque being transmitted from one of the indicating elements 35, 36 and 37 to a settable member associated with another of the indicating elements, an annular spacer 53 is interposed between the settable member 32 and the indicating element 36 and a further spacer 54 is interposed between the settable member 31 and the indicating element 35. These spacers are keyed to a sleeve 55 which embraces the latch 27 and extends through the central openings of the settable members. The sleeve has a "C"-shaped cross section with the pins 34 protruding from the latch between opposite edges of the "C". Radially inwardly projecting keys on the spacers 53 and 54 also engage between opposite edges of the sleeve.

There is in the base member 15 an opening 56 which is normally closed by a door 57. The door may be moulded of a resiliently flexible plastics material and include an integral catch and integral trunions for hingedly connecting the door with the base member.

With the latch 27 in its releasing position, the case to which the lock is applied open and the door 57 open, a user can gain access to the indicating elements 35, 36 and 37 through the opening 56. The user can apply torque to the indicating elements and rotate them relative to the settable members 30, 31 and 32. Whilst the latch is in its releasing position, the pins 34 prevent rotation of the settable members. Thus, a user can adjust each indicating element relative to the corresponding settable member to vary the digit which is presented in the corresponding window of the carrier 47 when the settable member is in the predetermined position which enables releasing movement of the latch 27 to be effected. Because each digit is duplicated at diametrically opposite positions on the indicating elements, there are presented in the middle of the opening 56 duplicates of the digits which are presented in the windows of the carrier. Whilst setting the indicating elements to give a selected combination of digits, the user can observe the digits through the opening 56 and does not need to observe the digits through the windows of the carrier.

The setting of each indicating element relative to its settable member cannot be changed whilst the door 57 is closed. Torque cannot be applied directly to the settable members and therefore the adjustment can be effected only when the settable members are constrained against rotation, by the latch being in its releasing position, and torque is applied to the indicating elements. When the latch is in its releasing position, there is no drive engagement between the driving elements 43, 44 and 45 and the indicating elements.

It will be noted that the windows of the carrier 47 are each close to a corresponding one of the driving elements 43, 44 and 45 so that when the driving element is being manipulated by a user, the indicia on the associated indicating element are likely to be obscured by the user.

It will be noted that, when the lock is in use, the fasteners which secure the lock to a case are not accessible from the outside of the case.

The hasp carrier 13 comprises a pair of blocks which are spaced apart and are connected by a cross piece 58. One of the blocks is indicated in FIG. 2 by the reference numeral 59. Respective grooves in both of the blocks receive opposite end portions of two pins, namely a pivot pin 60 on which the hasp 12 pivots and a further pin 61 which limits movement of the hasp relative to the hasp carrier 13. A spring 62 is interposed between the cross piece 58 and the hasp to urge the hasp away from the body 10 of the lock. The end portions of the pins 60 and 61 are concealed in use by the blocks of the hasp carrier and mid portions of these pins are concealed by the hasp itself. Thus the pins are not accessible.

The hasp 12 is assembled with the carrier 13 by inserting the pin 60 into the bore in the hasp, then inserting end portions of the pin 60 into the grooves in the blocks of the hasp carrier, next fitting the spring 62 between the cross piece and the hasp, then forcing the hasp towards the cross piece to compress the spring until the bore in the hasp for receiving the pin 61 is clear of the blocks and then inserting the pin 61 into its bore in the hasp. When the hasp is released, the spring 62 urges the hasp away from the carrier 13 and end portions of the pin 61 are carried into their grooves. The hasp carrier 13 is secured to the wall of the case by integral shanks which extend through apertures in the wall of the case and receive fasteners. Thus, the means by which the hasp carrier is secured to the wall of the case are not accessible from the outside of the case.

I claim:

1. In a lock mechanism comprising an operating member which, in use, normally imposes a constraint on an associated device but can undergo releasing movement to discontinue the constraint and a plurality of settable members, each of which can be set by an operator in a selected one of a number of alternative positions, it being necessary for the operator to establish a releasing combination of respective positions of the settable members before releasing movement of the operating member can occur, and further comprising indicating means for indicating visually to a user the respective positions to which the settable members have been set, the improvement comprising means for obscuring the indicating means, said means for obscuring and the indicating means being arranged for relative movement and means actuated by releasing movement of said operating member for causing relative movement between said obscuring means and said indicating means, whereby said indicating means is obscured.

2. In a lock mechanism comprising an operating member which, in use, normally imposes a constraint on an associated device but can undergo releasing movement to discontinue the constraint and a plurality of settable members, each of which can be set by an operator in a selected one of a number of alternative positions, it being necessary for the operator to establish a releasing combination of respective positions of the settable members before releasing movement of the operating member can occur, and further comprising indicating means for indicating visually to a user the respective positions to which the settable members have been set, the improvement comprising means for obscuring the indicating means, said means for obscuring and the indicating means being arranged for relative movement whenever releasing movement of the operating member occurs, whereby the indicating means is obscured upon releasing movement of the operating member, said means for obscuring comprising a window through which the indicating means can be viewed whilst the settable members are being set and, when releasing movement of the operating member is effected, the window and indicating means undergo relative movement such as to obscure the indicating means.

3. The improvement according to claim 2 wherein the window comprises a magnifying optical lens.

4. The improvement according to claim 3 wherein the indicating means comprises a respective indicating element for each settable element and wherein a respective lens is provided for each indicating element.

5. The improvement according to claim 2 wherein there is associated with each settable member a respective driving element which is accessible to a user and, when the obscuring means and indicating means undergo relative movement, relative movement of the driving elements and indicating means occurs, the driving elements remaining stationary relative to the obscuring means.

6. The improvement according to claim 5 wherein a respective window is provided for each settable member and each window is close to the corresponding driving element.

7. The improvement according to claim 2 wherein there is associated with each settable member a respective indicating element, each indicating element is marked with a row of indicia, each indicium in the row is duplicated, during normal operation of the mechanism each indicating element moves with the associated settable member, each indicating element is adjustable relative to the associated settable member, the mechanism is contained in a body having a window through which each indicating element is visible in use, at a side of the body opposite to the window there is an opening through which access can be gained to the indicating elements for the purpose of adjusting the indicating elements relative to the corresponding settable members and the arrangement is such that when a certain indicium is visible through the opening of the body, the duplicate of that indicium is visible through the window.

8. A lock mechanism according to claim 2 comprising a base member, a generally rectangular cover and a pair of end members, the end members having formations into which the cover fits and the end members further having integral fastening elements which project through apertures in the base member and fasten the end members to the base member.

9. A combination lock mechanism wherein there is associated with each settable member a respective driving element which is accessible to a user and the driving elements move with an operating member relative to the settable members when releasing movement of the operating member is effected.

* * * * *

UNITED STATES PATENT AND TRADEMARK OFFICE

CERTIFICATE OF CORRECTION

PATENT NO. : 4,287,734

DATED : September 8, 1981

INVENTOR(S) : LESLIE V. HERRIOTT

It is certified that error appears in the above-identified patent and that said Letters Patent are hereby corrected as shown below:

Title page, first column under "Foreign Priority data", delete

"May 18, 1977 [GB] United Kingdom .....20824/77"

Signed and Sealed this

*Twenty-ninth* Day of *December 1981*

[SEAL]

*Attest:*

GERALD J. MOSSINGHOFF

*Attesting Officer*

*Commissioner of Patents and Trademarks*